United States Patent [19]

Favata

[11] Patent Number: 4,461,563

[45] Date of Patent: Jul. 24, 1984

[54] COPY SHEET CONTAMINATION PREVENTION

[75] Inventor: Kenneth C. Favata, Webster, N.Y.

[73] Assignee: Xerox Corporation, Stamford, Conn.

[21] Appl. No.: 437,416

[22] Filed: Oct. 22, 1982

[51] Int. Cl.[3] ..... G03G 15/00; G03G 15/14

[52] U.S. Cl. ..... 355/3 TR; 355/3 R; 355/14 TR; 118/621; 430/48

[58] Field of Search ..... 355/3 TR, 14 TR, 3 R, 355/17; 118/621; 430/48

[56] References Cited

U.S. PATENT DOCUMENTS

| | | | |
|---|---|---|---|
| 3,414,409 | 12/1968 | Gallo, Jr. | 118/621 X |
| 3,707,138 | 12/1972 | Cartwright | 118/621 X |
| 3,721,551 | 3/1973 | Cantarano | 118/621 X |
| 3,734,724 | 5/1973 | York | 118/621 X |
| 3,860,857 | 1/1975 | Namiki et al. | 355/3 TR X |
| 4,014,605 | 3/1977 | Fletcher | 355/3 R |
| 4,077,709 | 3/1978 | Borostyan et al. | 355/3 TR |
| 4,141,728 | 2/1979 | Hemphill | 118/621 X |
| 4,402,591 | 9/1983 | Nakahata | 355/3 TR |

*Primary Examiner*—A. C. Prescott

*Attorney, Agent, or Firm*—H. Fleischer; J. E. Beck; R. Zibelli

[57] ABSTRACT

An apparatus in which contaminants transferred from a copy sheet to a photoconductive member are attracted back to the copy sheet. During the transfer of the toner powder image from the photoconductive member to the copy sheet, the copy sheet contaminants are attracted to the photoconductive member. Simultaneously with this transfer process, the copy sheet contaminants have their polarity charged to the same polarity as the polarity of the charge on the toner powder image. In this way, the contaminants are attracted back to the copy sheet from the photoconductive member preventing contamination thereof.

20 Claims, 3 Drawing Figures

COPY SHEET CONTAMINATION PREVENTION

This invention relates generally to an electrophotographic printing machine, and more particularly concerns preventing the transfer of copy sheet contaminants from the copy sheet to the photoconductive surface during the transfer process.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas within the original document. After the electrostatic latent image is recorded on the photoconductive member, the latent image is developed by bringing a developer material into contact therewith. This forms a toner powder image on the photoconductive member. Subsequently, the toner powder image is transferred to the copy sheet. Finally, the powder image is heated to permanently affix it to the copy sheet in image configuration.

During the transfer process, a copy sheet is brought into contact with the photoconductive member. An electrostatic charge is applied and the toner powder image transferred from the photoconductive member to the copy sheet. It has been found, particularly in electrophotographic printing machines wherein the photoconductive member is charged negatively and the toner powder image positively, that talc and kaoline transfer from the copy sheet to the photoconductive member. This occurs during th process of transferring the toner powder image from the photoconductive member to the copy sheet. These copy sheet contaminants, in turn, adhere electrostatically to the photoconductive member and are frequently not removed therefrom during the cleaning process. The copy sheet contaminants move with the photoconductive member to the development station where they are attracted into the development system. This is extremely deleterious to copy quality in that the development system now treats the copy sheet contaminants as particles which may be subsequently developed out on the photoconductive member. The larger copy sheet contaminants, such as talc, form agglomerates producing blotches on the copy sheet. These blotches are exceedingly unpleasing to the eye. It is apparent that it is highly desirable to prevent the attraction of copy sheet contaminants from the copy paper to the photoconductive member during the transfer process. Various approaches have been devised for transferring toner powder images from the photoconductive member to the copy sheet. The following disclosures appear to be relevant:

U.S. Pat. No. 3,414,409
Patentee: Gallo, Jr.
Issued: December 3, 1968
U.S. Pat. No. 3,707,138
Patentee: Cartwright
Issued: December 26, 1972
U.S. Pat. No. 3,721,551
Patentee: Cantarano
Issued: March 20, 1973
U.S. Pat. No. 3,734,724
Patentee: York
Issued: May 22, 1973
U.S. Pat. No. 4,014,605

-continued

Patentee: Fletcher
Issued: March 29, 1977
U.S. Pat. No. 4,141,728
Patentee: Hemphill
Issued: February 27, 1979

The relevant portions of the foregoing disclosures may be briefly summarized as follows:

Gallo, Jr. describes illumination through the backside of the photoconductor to transfer a toner powder image to a copy sheet.

Cartwright discloses a transfer apparatus in which a corona generator applies a charge on the photoconductive belt of the same polarity as the charge on the toner particles forming the powder image. The copy sheet passes into the nip defined by a conductive roller and the portion of the photoconductive belt passing over a support roller. The roller is electrically biased to a DC voltage of opposite polarity to the charge on the toner particles and applies pressure in the nip to effect transfer of the toner particles to the copy sheet. A lamp is disposed interiorly of the conductive roller to illuminate the photoconductive belt and reduce the charge attraction between the toner particles and photoconductive surface.

Cantarano describes illuminating the photoconductive surface to a high intensity light and electrically charging the powder to transfer the charged powder to a copy sheet.

York discloses transfer of the powder image from a photoconductive element to a conductive receiver sheet. The sheet is initially charged to the same polarity as the powder image. After the sheet is brought into contact with the photoconductive element, the polarity is reversed and the magnitude of the charge suitably adjusted. At this point, the transparent element of the photoconductive element is flood illuminated through the support side thereof to discharge the electrostatic latent image forces holding the developed image in place. The biasing potential is continued until the receiving sheet is separated from the photoconductive element to effect transfer of the powder image to the sheet.

Fletcher describes tailoring the transfer field by illuminating an electrically biased photoconductive belt supporting the copy sheet contacting the powder image on the photoconductive drum in the nip and post-nip areas.

Hemphill discloses an electrically biased transfer roll and a belt type photoreceptor. As the developed image moves through the transfer station, the copy sheet is charged positively to attract the negatively charged toner, and the photoconductive belt is negatively charged while being exposed to a light source through the copy sheet. The photoconductive layer could also be exposed from the opposite side thereof by using a suitable transparent conductive substrate.

In accordance with one aspect of the present invention, there is provided an apparatus for transferring an electrically charged toner powder image from a photoconductive member to a sheet of support material having particle contaminants. Means are provided for applying an electrical charge to the sheet of support material of a polarity opposite in polarity to the polarity of the charge on the toner powder image. This attracts the toner powder image from the photoconductive member to the sheet of support material. The particle contaminants of the sheet support material are attracted from the sheet of support material to the photoconductive member. Means induce a charge on the contaminants attracted from the sheet of support material to the photoconductive member of the same polarity as the polarity of the charge on the toner powder image. In this way, the contaminants are attracted back to the sheet of support material.

Pursuant to another aspect of the present invention, there is provided an electrophotographic printing machine of the type having an electrically charged toner powder image on a photoconductive member. Means advance a sheet of support material having particle contaminants into contact with the toner powder image on the photoconductive member. Means are then provided for applying an electrical charge to the sheet of support material of an opposite polarity to the charge on the toner powder image. This attracts the toner powder image from the photoconductive member to the sheet of support material. The particle contaminants of the sheet of support material are attracted from the sheet of support material to the photoconductive member. Means induce a charge on the contaminants attracted from the sheet of support material to the photoconductive member of the same polarity as the polarity of the charge on the toner powder image causing the contaminants to be attracted back to the sheet of support material.

Still another aspect of the present invention is a method of transferring an electrically charged toner powder image from a photoconductive member to a sheet of support material having particle contaminants. The method includes the steps of applying an electrical charge to the sheet of support material of an opposite polarity to the charge on the toner powder image. This attracts the toner powder image from the photoconductive member to the sheet of support material. The particle contaminants are attracted from the sheet of support material to the photoconductive member. Thereafter, the contaminants have a charge of the same polarity as the polarity of the charge of the toner powder image induced thereon. This causes the particle contaminant to be attracted from the photoconductive member back to the sheet of support material.

Finally, another aspect of the present invention is the method of electrophotographic printing wherein an electrically charged toner powder image is transferred from a photoconductive member to a sheet of support material having particle contaminants. During this process, an electrical charge is applied to the sheet of support material of an opposite polarity to the charge on the toner powder image. This attracts the toner powder image from the photoconductive member to the sheet of support material. The contaminants are attracted from the sheet of support material to the photoconductive member. The contaminants have a charge of the same polarity as the polarity of the charge on the toner powder image induced thereon. This attracts the contaminants from the photoconductive member back to the sheet of support material.

Other aspects of the present invention will become apparent as the following description proceeds and upon reference to the drawings, in which.

While the present invention will hereinafter be described in connection with a preferred embodiment and method of use, it will be understood that it is not intended to limit the invention to that embodiment and method of use. On the contrary, it is intended to cover all alternatives, modifications and equivalents as may be included within the spirit and scope of the invention as defined by the appended claims.

Figure 1:
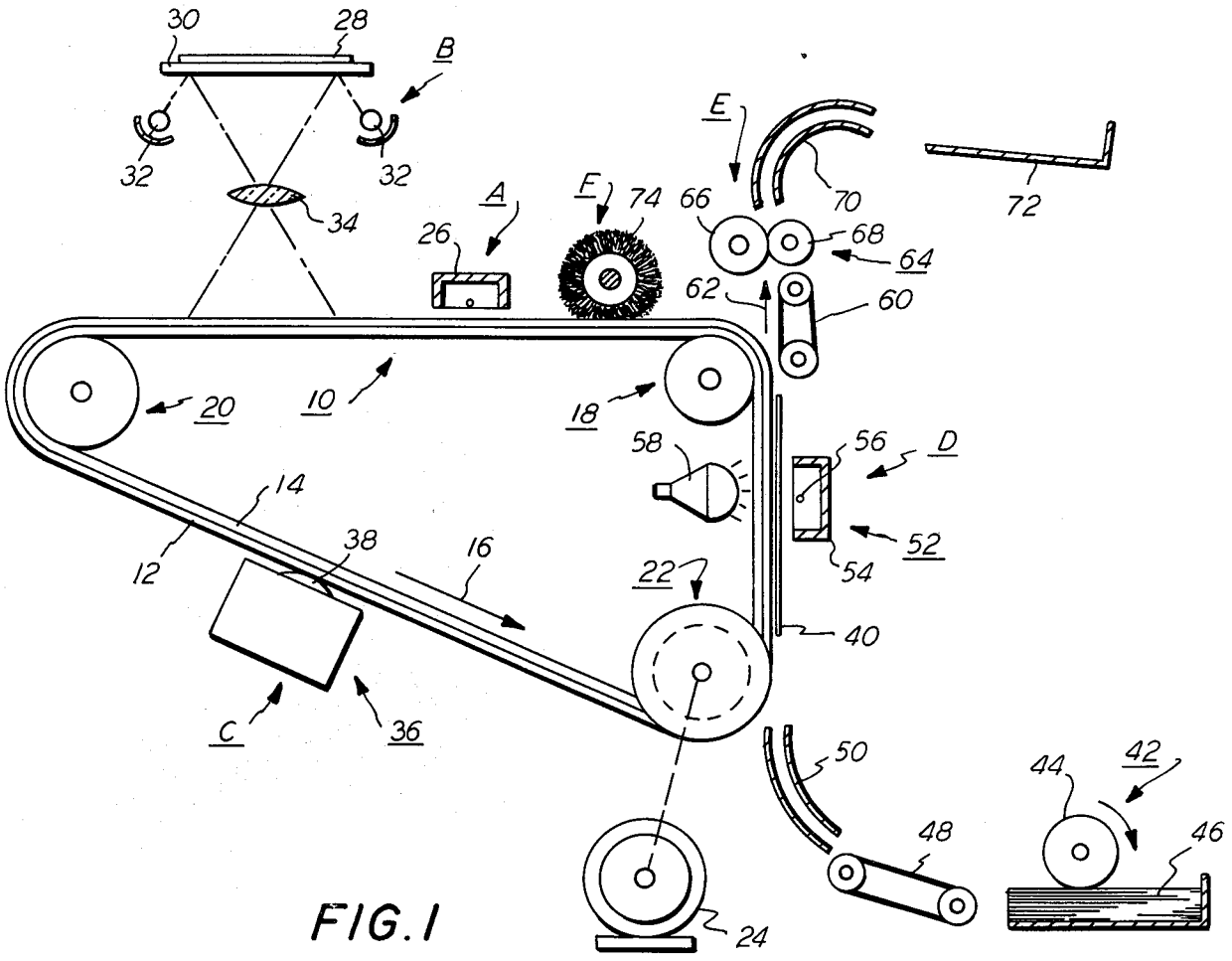
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the transfer apparatus of the present invention therein. It will become evident from the following discussion that this apparatus is equally well suited for use in a wide variety of electrostatographic printing machines or other types of devices requiring the transfer of charged particles to a sheet containing particle contaminants, and is not necessarily limited in its application to the particular embodiment or method of use described herein.

In the illustrative electrophotographic printing machine, as shown in FIG. 1, a belt 10 having a photoconductive surface 12 deposited on a conductive substrate 14 moves in the direction of arrow 16. Preferably, the conductive substrate comprises a transparent support such as poly (ethylene terephathalate) cellulose acetate or other suitable photographic film supports, typically having coated thereon a transparent conductive coating such as high vacuum evaporated nickel, cuprous idiode, or any suitable conducting polymer. The conductive support is, in turn, overcoated with a photoconductive layer typically comprising a binder and an organic photoconductor. A wide variety of organic photoconductors may be employed in this invention. For example, an organic amine photoconductor or a polarylakane photoconductor may be employed. However, one skilled in the art will appreciate that any type of organic photoconductor suitable for use with a transparent conductive substrate may be utilized in the present invention. Various types of photoconductors are described in U.S. Pat. No. 3,734,724 issued to York in 1973, the relevant portions thereof being hereby incorporated into the present application. In the exemplary electrophotographic printing machine, the photoconductive layer has an electrostatic charge of a negative polarity recorded thereon with the charge on the toner particles being of a positive polarity.

With continued reference to FIG. 1, belt 10 moves in the direction of arrow 16 to advance successive portions of photoconductive surface 12 through the various processing stations disposed about the path of movement thereof. As shown, belt 10 is entrained about stripping roller 18, tension roller 20 and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a drive belt. Drive roller 22 includes a pair of opposed spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted rotatably. These rollers are idlers which rotate freely as belt 10 moves in the direction of arrow 16.

Initially, a portion of belt 10 passes through charging station A. At charging station A, a corona generating device, indicated generally by the reference numeral 26, charges photoconductive surface 12 of belt 10 to a relatively high, substantially uniform potential having a negative polarity. One skilled in the art will appreciate that the polarity of the charge imposed upon the photoconductive surface depends upon the selected photoconductor and a suitable photoconductor may be utilized wherein a positive polarity is applied rather than a negative polarity.

Next, the charged portion of photoconductive surface 12 is advanced through exposure station B. At exposure station B, an original document 28 is positioned facedown upon a transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on the photoconductive surface having a negative polarity which corresponds to the informational areas contained within original document 28. Thereafter, belt 10 advances the electrostatic latent image recorded on photoconductive surface 12 to development station C.

At development station C, a magnetic brush development system, indicated generally by the reference numeral 36, transports a developer mixture comprising carrier granules having toner particles adhering triboelectrically thereto into contact with the electrostatic latent image recorded on photoconductive surface 12. The toner particles have a positive charge thereon so as to be attracted to the negatively charged latent image. Magnetic brush development system 36 includes a magnetic brush developer roller 38. Magnetic brush developer roller 38 forms a brush of carrier granules and toner particles. The toner particles are attracted from the carrier granules to the latent image forming a toner powder image on photoconductive surface 12 of belt 10.

After development, belt 10 advances the toner powder image to transfer station D. At transfer station D, a sheet of support material is moved into contact with the toner powder image. The sheet of support material is paper having particle contaminants thereon. Typical particle contaminants are Kaoline and talc. The copy paper is advanced to transfer station D by a sheet feeding apparatus, indicated generally by the reference numeral 42. Preferably, sheet feeding apparatus 42 includes a feed roller 44 contacting the uppermost stack of sheet 46. Feed roll 44 rotates to advance the uppermost sheet from stack 46 onto conveyor 48. Conveyor 48 transports the sheet into chute 50 which guides sheet 40 into contact with photoconductive surface 12 of belt 10 in a timed sequence so that the toner powder image developed thereon contacts the advancing sheet 40 at transfer station D.

Transfer station D includes a corona generating device 52 which sprays negative ions onto the backside of sheet 40. In this way, sheet 40 is charged to an opposite polarity from the toner powder image adhering to photoconductive surface 12 of belt 10. The toner powder image is attracted from photoconductive surface 12 to sheet 40. Preferably, corona generating device 52 comprises a U-shaped conductive shield 54 and a coronode wire 56. The efficiency in transferring the toner powder image from the photoconductive surface to the copy sheet is controlled by the magnitude of two competing forces, i.e. the field due to the charge on the copy sheet which attracts the toner powder image thereto and the field due to the electrostatic latent image which attracts the toner powder image to the photoconductive surface. Thus, the charge on the copy sheet must be greater than the charge on the photoconductive surface in order to effect transfer of the toner powder image. Negative charge on the copy sheet must be of a greater magnitude than the negative charge of the latent image. However, a problem arising in a system of this type is that the particle contaminants of the copy sheet 40, e.g. talc and Kaoline, are also attracted to the photoconductive surface. The particle contaminants may be negatively charged as a result of the transfer process or due to any other nonrelated cause. Even neutrally charged particles have been found to be mechanically transferred from the copy sheet to photoconductive surface 12. A solution to this problem is to induce a charge on these particles having the same polarity as the polarity of the charge on the toner particles. In this way, the contaminants act as toner particles and are attracted back to the copy sheet. This is achieved by energizing light source 58. Light source 58 is positioned at transfer station D so that light rays therefrom are transmitted through conductive surface 14 onto the backside of photoconductive surface 12 at transfer station D. These light rays produce a flow of positive ions to the free surface of photoconductive surface 12 inducing a charge of a positive polarity on the particle contaminants attracted thereto. In this way, the particle contaminants have a charge of the same polarity as the polarity of the toner particles and are attracted back to the copy sheet from the photoconductive surface preventing contamination of the printing machine.

It will be appreciated that the illumination generated by light source 58 may be either visible or invisible radiant energy, depending on the radiant energy sensitivity of the photoconductive material. The foregoing process is shown in greater detail in FIG. 2.

Referring again to FIG. 1, after the toner powder image has been transferred to copy sheet 40, conveyor 60 advances the sheet in the direction of arrow 62 to fusing station E. Fusing staion E includes a fuser assembly, indicated generally by the reference 64, which permanently affixes the transferred toner powder image to copy sheet 40. Preferably, fuser assembly 64 includes a heated fuser roll 66 and a back-up roll 68. Sheet 40 passes between fuser roll 66 and back-up roll 68 with the toner powder image contacting fuser roll 68. In this manner, the toner powder image is permanently affixed to copy sheet 40. After fusing, chute 70 guides the advancing sheet to catch tray 72 for subsequent removal from the printing machine by the operator.

Invariably, after the copy sheet is separated from the photoconductive surface 12 of belt 10, some residual toner particles remain adhering thereto. These residual toner particles are removed from the photoconductive surface at cleaning station F. Cleaning station F includes a pre-clean corona generating device (not shown) and a rotatably mounted fibrous brush 74 in contact with photoconductive surface 12. The pre-clean corona generating device neutralizes the charge attracting the toner particles to the photoconductive surface. These particles are cleaned from the photoconductive surface by the rotation of brush 74 in contact therewith. Subsequent to cleaning, a discharge lamp (not shown) floods photoconductive surface 12 with light to dissipate any residual charge remaining thereon prior to the charging thereof for the next successive imaging cycle. It is believed that the foregoing description is sufficient for purposes of the present application to illustrate the general operation of the illustrative electrophotographic printing machine incorporating the features of the present invention therein.

Figure 2:
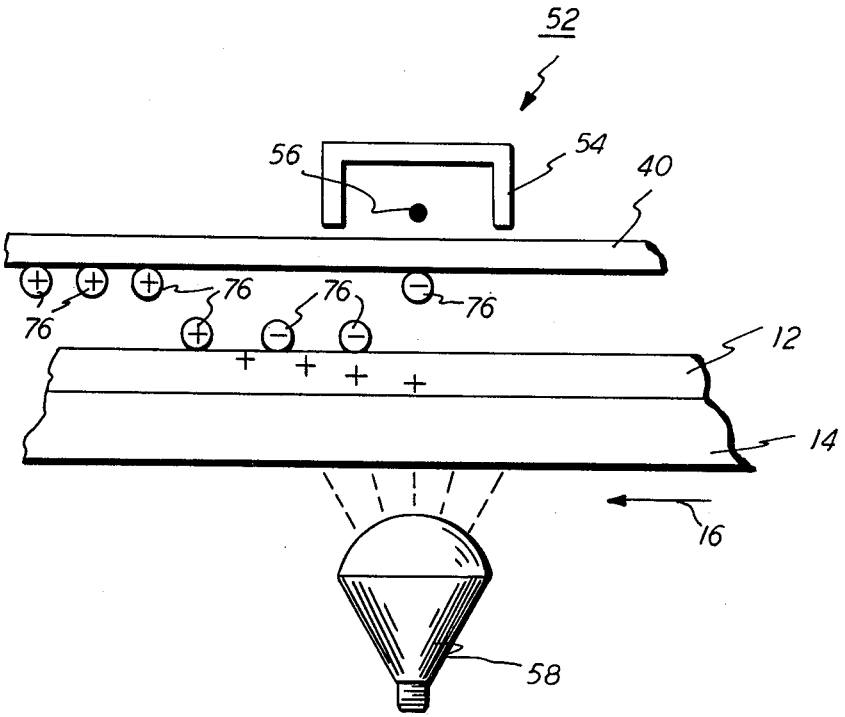
FIG. 2 is a fragmentary elevational view showing schematically the transfer of the particle contaminants from the sheet of support material to the photoconductive member and their attraction back to the sheet of support material.

Referring now to FIG. 2, there is shown the features of the present invention in greater detail. As depicted thereat, corona generating device 52 is energized. In this way, coronode wire 56 is excited to produce negative ions. Since the magnitude of the negative charge of the electrostatic latent image is less than the magnitude of the negative charge on the sheet of support material, any negatively charged contaminants are attracted from the sheet of support material to the photoconductive surface. Simultaneously therewith, lamp 58, positioned to transmit light rays through transparent conductive substrate 14 onto the backside of photoconductive surface 12, is energized. Energization of lamp 58 causes positive ions to move toward the free surface of photoconductive layer 12. It has been found that the particle contaminants are electrically conductive. The negatively charged particle contaminants, indicated generally by the reference numeral 74, are initially attracted to the free surface of photoconductive layer 12. As the positive ions move to the free surface of photoconductive layer 12, they induce a positive charge in any conductive particle contaminants adhering to the surface thereof. The negative charge on copy sheet 40 then attracts the now positively charged particle contaminants back to the copy sheet. Thus, illumination of the back of the photoconductive layer during the process of transferring the toner powder image from the surface of the photoconductive layer to the copy sheet causes positive charges to flow to the free surface of the photoconductive layer under the influence of the transfer field. The positive charge at the free surface of the photoconductive layer induces a positive charge in the conductive particle contaminants in contact therewith. These, now positively charged particle contaminants, are attracted back to the negatively charged copy sheet. In this manner, the particle contaminants of the copy sheet are initially attracted to the photoconductive layer and then back to the copy sheet. The particle contaminants are therefore prevented from being transported to the respective processing stations by the photoconductive belt. It has been found that this mechanism causes a majority of the charged particle contaminants to be of the same polarity as th polarity of the toner powder image. In this way, the rate of accumulation of particle contaminants on the photoconductive surface is significantly reduced with the positively charged contaminants tending to be transferred back to the copy sheet under the influence of the transfer field.

Figure 3:
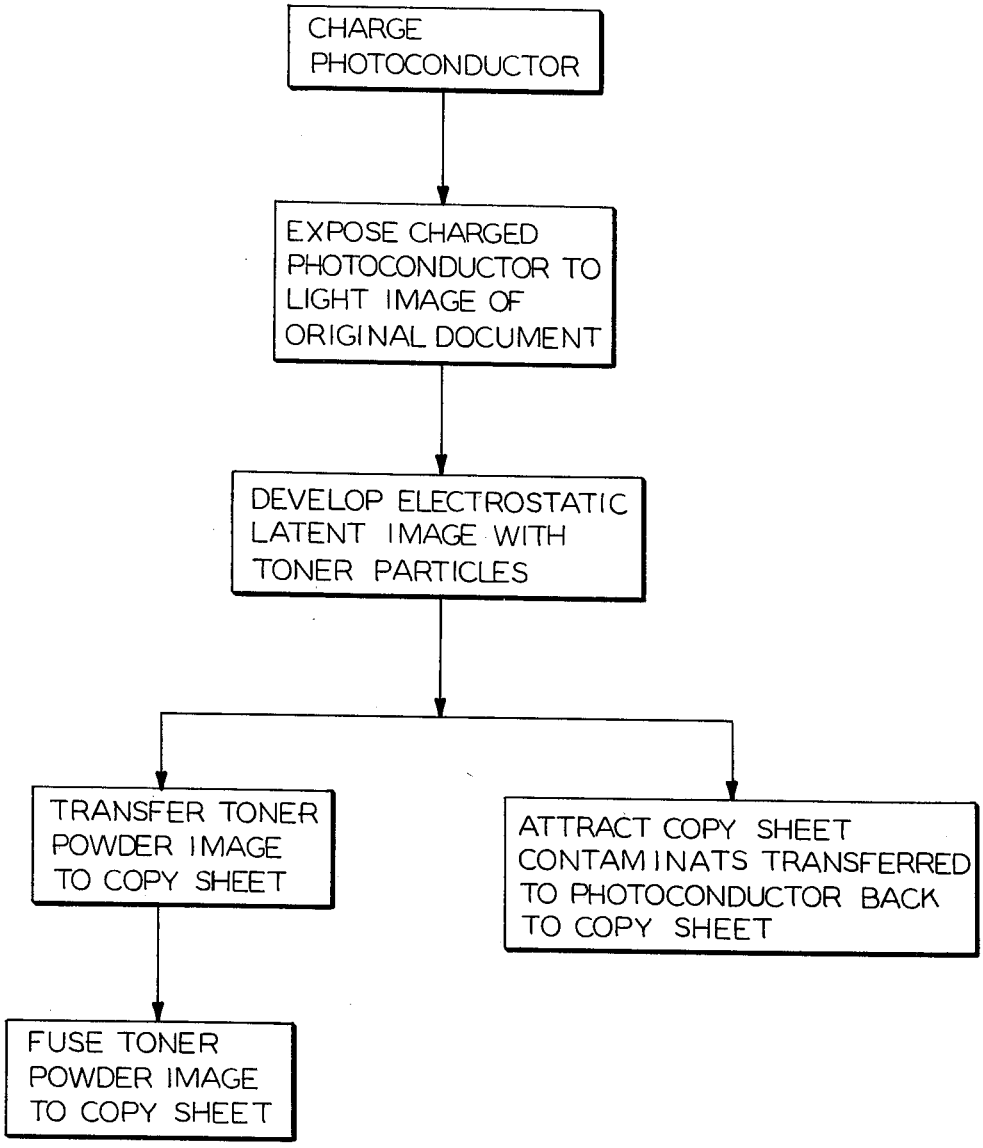
FIG. 3 is a flow chart illustrating the electrophotographic printing machine process and the manner in which particle contamination is prevented.

Referring now to FIG. 3, there is shown a flow chart illustrating the electrophotographic printing process using copy sheets having particle contaminants. As shown, the photoconductive surface is initially charged to a suitable polarity and magnitude. Thereafter, the charged portion of the photoconductive surface is selectively discharged by being exposed to a light image of an original document. This records an electrostatic latent image on the photoconductive surface. The electrostatic latent image is developed with toner particles. The toner particles are of an opposite polarity to the polarity of the electrostatic latent image. Thereupon, the toner powder image is transferred to the copy sheet, and simultaneously therewith, the copy sheet particle contaminants attracted to the photoconductive surface are attracted back to the copy sheet. Finally, the toner powder image is fused to the copy sheet producing the resultant copy. The process heretofore described results in a significant reduction in the accumulation of copy sheet particle contaminants on the free surface of the photoconductive layer. It has been found that there is as much as a 30 to 50% reduction in the accumulation of contaminants by the foregoing process.

It is, therefore, evident that there has been provided, in accordance with the present invention, an apparatus for transferring a toner powder image from a photoconductive member to a copy sheet having particle contaminants wherein the particle contaminants attracted to the photoconductive member during the transfer process are attracted back to the copy sheet. This results in a significant reduction in the accumulation of particle contaminants on the photoconductive surface preventing degradation of copy quality. The foregoing apparatus fully satisfies the aims and advantages hereinbefore set forth. While this invention has been described in conjunction with a specific embodiment and method of use thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for transferring an electrically charged toner powder image from a photoconductive member to a sheet of support material having particle contaminants, including:

means for applying an electrical charge to the sheet of support material of a polarity opposite in polarity to the polarity of the charge on the toner powder image so as to attract the toner powder image from the photoconductive member to the sheet of support material with the particle contaminants of the sheet of support material being attracted from the sheet of support material to the photoconductive member; and means for inducing a charge on the contaminants attracted from the sheet of support material to the photoconductive member of the same polarity as the polarity of the charge on the toner powder image causing the contaminants to be attracted back to the sheet of support material.

2. An apparatus according to claim 1, wherein said applying means and said inducing means operate simultaneously.

3. An apparatus according to claim 2, wherein said applying means includes a corona generating device which sprays ions onto the side of the sheet of support material opposed from the photoconductive member.

4. An apparatus according to claim 3, wherein said inducing means includes a light source arranged to illuminate the portion of the photoconductive member having the toner powder image being transferred therefrom.

5. An apparatus according to claim 4, wherein the photoconductive member includes a substantially transparent conductive layer having a photoconductive layer secured thereon.

6. An apparatus according to claim 5, wherein said light source is positioned opposed from the transparent conductive layer so that the light rays transmitted therefrom pass through the transparent conductive layer onto the photoconductive layer.

7. An electrophotographic printing machine of the type having an electrically charged toner powder image on a photoconductive member, including:

means for advancing a sheet of support material having particle contaminants into contact with the toner powder image on the photoconductive member;

means for applying an electrical charge to the sheet of support material of a polarity opposite in polarity to the polarity of the charge on the toner powder image so as to attract the toner powder image from the photoconductive member to the sheet of support material with the particle contaminants of the sheet of support material being attracted from the sheet of support material to the photoconductive member; and means for inducing a charge on the contaminants attracted from the sheet of support material to the photoconductive member of the same polarity as the polarity of the charge on the toner powder image causing the contaminants to be attracted back to the sheet of support material.

8. A printing machine according to claim 7, wherein said applying means and said inducing means operate simultaneously.

9. A printing machine according to claim 8, wherein said applying means includes a corona generating device which sprays ions onto the side of the sheet of support material opposed from the photoconductive member.

10. A printing machine according to claim 9, wherein said inducing means includes a light source arranged to illuminate the portion of the photoconductive member having the toner powder image being transferred therefrom.

11. A printing machine according to claim 10, wherein the photoconductive member includes a substantially transparent conductive layer having a photoconductive layer secured thereon.

12. A printing machine according to claim 11, wherein said light source is positioned opposed from the transparent conductive layer so that the light rays transmitted therefrom pass through the transparent conductive layer onto the photoconductive layer.

13. A method of transferring an electrically charged toner powder image from a photoconductive member to a sheet of support material having particle contaminants, including the steps of:

applying an electrical charge to the sheet of support material of an opposite polarity to the charge on the toner powder image so as to attract the toner powder image from the photoconductive member to the sheet of support material with the particle contaminants of the sheet of support material being attracted from the sheet of support material to the photoconductive member;

and inducing a charge on the contaminants attracted from the sheet of support material to the photoconductive member of the same polarity as the polarity of the charge on the toner powder image causing the contaminants to be attracted back to the sheet of support material.

14. A method according to claim 13, wherein said step of applying and inducing occur simultaneously.

15. A method according to claim 14, wherein said step of applying includes the step of spraying ions onto the side of the sheet of support material opposed from the photoconductive member.

16. A method according to claim 14, wherein said step of inducing includes the step of illuminating the portion of the photoconductive member having the toner powder image being transferred therefrom.

17. A method of electrophotographic printing of the type wherein an electrically charged toner powder image is transferred from a photoconductive member to a sheet of support material having particle contaminants, including the steps of:

applying an electrical charge to the sheet of support material of an opposite polarity to the charge on the toner powder image so as to attract the toner powder image from the photoconductive member to the sheet of support material with the particle contaminants of the sheet of support material being attracted from the sheet of support material to the photoconductive member;

and inducing a charge on the contaminants attracted from the sheet of support material to the photoconductive member of the same polarity as the polarity of the charge on the toner particles causing the contaminants to be attracted back to the sheet of support material.

18. A method of printing according to claim 17, wherein said step of applying and inducing occur simultaneously

19. A method of printing according to claim 18, wherein said step of applying includes the step of spraying ions onto the side of the sheet of support material opposed from the photoconductive member.

20. A method of printing according to claim 18, wherein said step of inducing includes the step of illuminating the portion of the photoconductive member having the toner powder image being transferred therefrom.

* * * * *